US005747753A

United States Patent [19]

Eder

[11] Patent Number: 5,747,753

[45] Date of Patent: May 5, 1998

[54] MUFFLER FOR AN INTERNAL COMBUSTION ENGINE, PARTICULARLY A SINGLE-CYLINDER DIESEL ENGINE

[75] Inventor: Erich Eder, Vornbach/Inn, Germany

[73] Assignee: Motorenfabrik Hatz GmbH & Co., Vornbach/Inn, Germany

[21] Appl. No.: 587,674

[22] Filed: Jan. 16, 1996

Related U.S. Application Data

[63] Continuation of PCT/IB94/00200, Jul. 5, 1994.

[30] Foreign Application Priority Data

Jul. 15, 1993 [DE] Germany ..... 43 23 642.1

[51] Int. Cl.[6] ..... F01N 7/18

[52] U.S. Cl. ..... 181/282

[58] Field of Search ..... 181/229, 230, 181/237, 255, 282, 254

[56] References Cited

U.S. PATENT DOCUMENTS

| | | | |
|---|---|---|---|
| 3,783,590 | 1/1974 | Allen | 181/230 |
| 3,969,895 | 7/1976 | Krizman | 181/237 |

*Primary Examiner*—Khanh Dang
*Attorney, Agent, or Firm*—Helfgott & Karas, P.C.

[57] ABSTRACT

A silencer for a single-cylinder diesel engine has a housing with an exhaust fume inlet at the side of the cylinder head and an outlet (2) to which is associated a baffle plate (5) mounted so as to vibrate and whose surface corresponds to at least the cross-section of the outlet (2). The baffle plate (5) is secured to the free end of a leaf spring whose other end is linked to the housing (1) of the silencer.

11 Claims, 1 Drawing Sheet

MUFFLER FOR AN INTERNAL COMBUSTION ENGINE, PARTICULARLY A SINGLE-CYLINDER DIESEL ENGINE

This is a continuation of application Serial No. PCT/IB94/00200 filed on Jul. 5, 1994.

BACKGROUND OF THE INVENTION

1. Field of the Invention

The invention relates to a muffler for an internal combustion engine, particularly for a single-cylinder diesel engine, with a muffler housing, which has an inlet opening on the cylinder-head side for the exhaust gas and an outlet opening, to which a springy cover is assigned, which is disposed on the outside of the muffler housing.

2. Description of the Prior Art

Such mufflers usually are divided into chambers and have baffles in the form of perforated plates, resonators, linings of sound absorbing materials or the like.

In the case of a muffler of the above-mentioned type with a divided muffler housing known from the German Offenlegungsschrift 14 76 582, a springy cover is assigned to the outlet opening. The cover is a leaf-shaped tongue having as low a stiffness as possible, so that its deflection must be limited by a rigid stop, preshaped in accordance with the fully deflected shape of the tongue.

SUMMARY OF THE INVENTION

As against this, it is an object of the present invention to provide a muffler of particularly simple construction for small diesel engines, which can be produced at a correspondingly low cost but is at least equivalent to the known solution with respect to its effectiveness.

Pursuant to the invention, this objective is accomplished owing to the fact that the muffler housing is constructed essentially without baffles, partition walls, and the like, that the cover is constructed as a baffle plate, oscillatingly mounted by means of a spring, so that the baffle plate is held in a floating manner with respect to the outlet opening and at a slight distance from it, and that the spring is constructed as a leaf spring, to the free end of which the baffle plate is fastened and the other end of which is connected with the muffler housing at a distance from the outlet opening.

It is of decisive importance here that low manufacturing costs are achieved for the muffler housing as well as for the solution characteristics directly responsible for the muffling effect. A muffler housing, cast without partition walls, can be produced particularly inexpensively in comparison to mufflers of welded iron plate; instead of expensive baffles in the muffler housing, only a baffle plate is mounted in front of the outlet opening. This baffle plate can easily be matched to the exhaust gas oscillation, for example by the nominal RPM by selecting a baffle plate of suitable thickness or by additionally mounting a gyrating mass. Moreover, the oscillation of the baffle plate is determined materially by the dimensioning of the leaf spring, to the free end of which the baffle plate is fastened, so that it can be kept oscillating closely in front of the outlet opening. The spring thus does not lie on the collar of the outlet opening, but hovers a little distance above it. Moreover, the leaf spring can also be supported by an adjustable screw, which is propped with respect to the muffler housing. The effect of the adjustable screw on the oscillation of the leaf spring depends substantially on the site of the support and on the path of the adjustment.

The inventive muffler consists of only a few components. The muffler housing advisably is cast as a one-part housing of aluminum. The leaf spring with the baffle plate is screwed onto the muffler housing from the outside; otherwise, the leaf spring carries only a few components, namely the baffle plate and optionally a gyrating mass, which however, in a further simplification, can be replace by the rivet head or heads, by means of which the baffle plate is fastened to the leaf spring.

Experiments have shown that the noise protection values, which commercial or industrial propulsion systems aim for, can be maintained with these simple means.

BRIEF DESCRIPTION OF THE DRAWING

In the following, an example of the invention is explained by means of the drawing, in which.

DESCRIPTION OF THE PREFERRED EMBODIMENT

Figure 1:
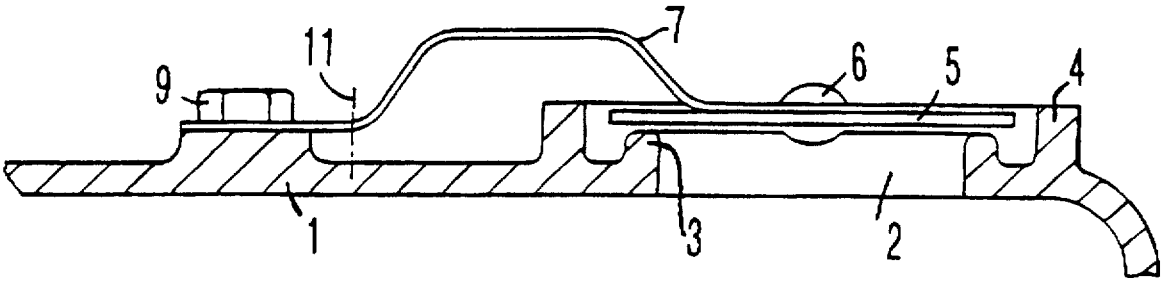
FIG. 1 shows a cross section through a section of the muffler housing and FIG. 2 shows a plan view of the baffle plate with a holding device for the leaf-spring.
Figure 2:
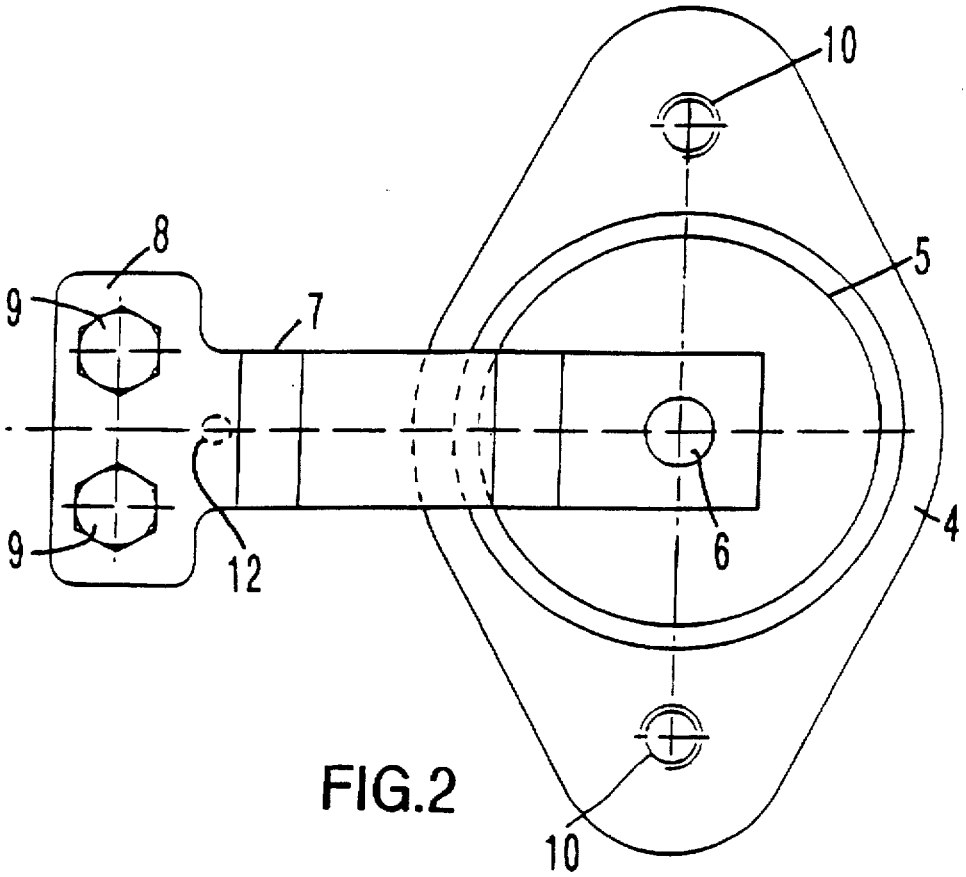

FIG. 1 shows a section of the muffler housing 1 of cast aluminum with an outlet opening 2 for the exhaust gas. The outlet opening 2 preferably is provided on the upper side of the muffler housing. It is limited by a projecting collar 3, which is surrounded at a small distance by a collar-shaped projection 4. The projection 4 protrudes over the collar 3, so that a baffle plate 5, covering the outlet opening 2, essentially is disposed within the projection 4. The baffle plate 5 is connected by means of a rivet 6 with a leaf spring 7, which is offset upward above the projection 4 and bolted with its other end to the housing. The baffle plate 5 is disposed closely above the collar 3; it is caused to oscillate in the region of the outlet opening 2 by the pulsating exhaust gases. The oscillating system, consisting of baffle plate 5, rivet 6 and leaf spring 7, is designed so that the baffle plate vibrates under the action of the pulsing exhaust gases, without however touching the collar 3. Advisably, said oscillating system is matched to the exhaust gas frequency by the nominal RPM of the engine. The plan view of FIG. 2 shows that the leaf spring is broadened at its end 8, at which it is fastened. Two fastening screws 9 are screwed through the broadened end 8 into the muffler housing. The collar-shaped projection 4 forms a flange with two threaded boreholes 10; the latter are provided only for the case in which, instead of a baffle plate 5, different types of exhaust gas compensators are to be fastened over the outlet opening.

With the axis 11 in FIG. 1 and the broken-line cross section 12, an adjustable screw is indicated, which is seated in a threaded borehole of the housing 1 and can be braced from below against the leaf spring 7. In this manner, the possibility exists of influencing the natural oscillation of the above-described oscillation system.

What is claimed is:

1. A muffler for an internal combustion engine, particularly for a single-cylinder diesel engine, comprising a muffler housing, a baffle plate and a leaf spring, said muffler housing being provided with an inlet opening and an outlet opening for exhaust gas, wherein the baffle plate is oscillatingly mounted by means of the leaf spring to the muffler housing in that one end of the leaf spring is connected to the muffler housing at a distance from the outlet opening and the baffle plate is fastened to the other end of the leaf spring, and wherein the baffle plate is disposed on the outside of the muffler housing at a slight distance from the outlet opening.

2. The muffler of claim 1, wherein said muffler housing is a cast muffler housing provided without baffles, partition wall or the like.

3. The muffler of claim 2, wherein said cast muffler housing is manufactured in one part as a cast housing.

4. The muffler of claim 1, wherein the baffle plate is connected at its center with the leaf spring.

5. The muffler of claim 1, further including a gyrating mass, matched to the oscillation of the exhaust gas, and fastened to the baffle plate.

6. The muffler of claim 5, wherein the gyrating mass is fastened to said center of said baffle plate.

7. The muffler of claim 1, wherein the outlet opening is limited by a collar of the muffler housing projecting to the outside.

8. The muffler of claim 7, wherein the collar is surrounded at a distance by a collar-shaped projection, which protrudes beyond the collar.

9. The muffler of claim 8, wherein the baffle plate is larger than the collar, but smaller than the projection, so that it is enclosed laterally by the projection.

10. The muffler of claim 9, wherein the projection protrudes over the baffle plate.

11. The muffler of claim 1, wherein the leaf spring runs at a distance from the outside of the muffler housing and, outside of the point at which it is fastened to the muffler housing, is supported by an adjustable screw for influencing its spring properties, the adjustable screw being adjustably accommodated in the threaded borehole of the muffler housing.

* * * * *